US006964071B1

(12) United States Patent
Lahmann

(10) Patent No.: US 6,964,071 B1
(45) Date of Patent: Nov. 15, 2005

(54) BASSINET TUB RETAINING ARRANGEMENT

(75) Inventor: Dennis W. Lahmann, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/913,989

(22) Filed: Aug. 6, 2004

(51) Int. Cl.[7] ..... A47D 9/04
(52) U.S. Cl. ..... 5/93.1; 5/2.1; 5/97
(58) Field of Search ..... 5/93.1, 97, 2.1, 5/655.5; 4/548, 586

(56) References Cited

U.S. PATENT DOCUMENTS 2,280,913 A * 4/1942 Hummel et al. ..... 5/2.1
2,752,614 A * 7/1956 Hayward ..... 5/93.1
4,302,857 A * 12/1981 Kodet et al. ..... 5/2.1
4,819,282 A 4/1989 McArthur et al.

* cited by examiner

*Primary Examiner*—Alison Pickard
*Assistant Examiner*—Fredrick Conley
(74) *Attorney, Agent, or Firm*—Flynn, Thiel, Boutell & Tanis, P.C.

(57) ABSTRACT

A bassinet support unit receives a tub-shaped bassinet. C-shaped hook elements mounted on the respective ends the bassinet are each configured to receive a corresponding elongate support rod that extends across a respective end of the bassinet support unit. The selected C-shaped hook element receives the corresponding support rod and thus inclines the bassinet with respect to a flat substantially horizontal planar top piece of the bassinet support unit. When an at least partially upward force is applied to the bassinet a lower end portion of the C-shaped hook element then receives a part of the support rod. The lower end portion then prevents upward movement of the bassinet and/or limits rotative movement of the bassinet about a longitudinal axis thereof. In some embodiments a pair of J-shaped hook element having openings facing each other can be utilized.

17 Claims, 5 Drawing Sheets

BASSINET TUB RETAINING ARRANGEMENT

FIELD OF THE INVENTION

This invention relates to an arrangement for maintaining a bassinet on a bassinet support unit at predetermined inclined angles with respect to a horizontal position.

BACKGROUND OF THE INVENTION

Infant bassinets are used in nurseries, delivery rooms and special birthing units. Infant bassinets are usually designed to eliminate unnecessary disturbances of infants. Arrangements for tilting bassinets mounted on corresponding bassinet support units to Trendelenburg and reverse-Trendelenburg positions are known in the prior art.

In one prior art embodiment, J-shaped hooks are fixedly secured at ends of the bassinet. The hooks mount to rods at ends of a bassinet support unit to provide an inclined position in a longitudinal direction for the bassinet. However, if a force applied accidentally or otherwise moves the bassinet upwardly, there is a possibility that the hooks will unseat and/or that the bassinet will rotate about its longitudinal axis and tip or fall from the inclined position.

It is therefore an object of the present invention to provide an arrangement wherein a bassinet placed upon a bassinet support unit is maintained in an inclined position even when forces applied against the bassinet begin to lift or rotate the inclined bassinet from a support rod.

SUMMARY OF THE INVENTION

The objects and purposes of the invention are met by providing an arrangement that prevents unseating of hooks on an inclined bassinet from a support rod and that limits rotation of the bassinet about a longitudinal axis thereof.

DETAILED DESCRIPTION

Figure 1:
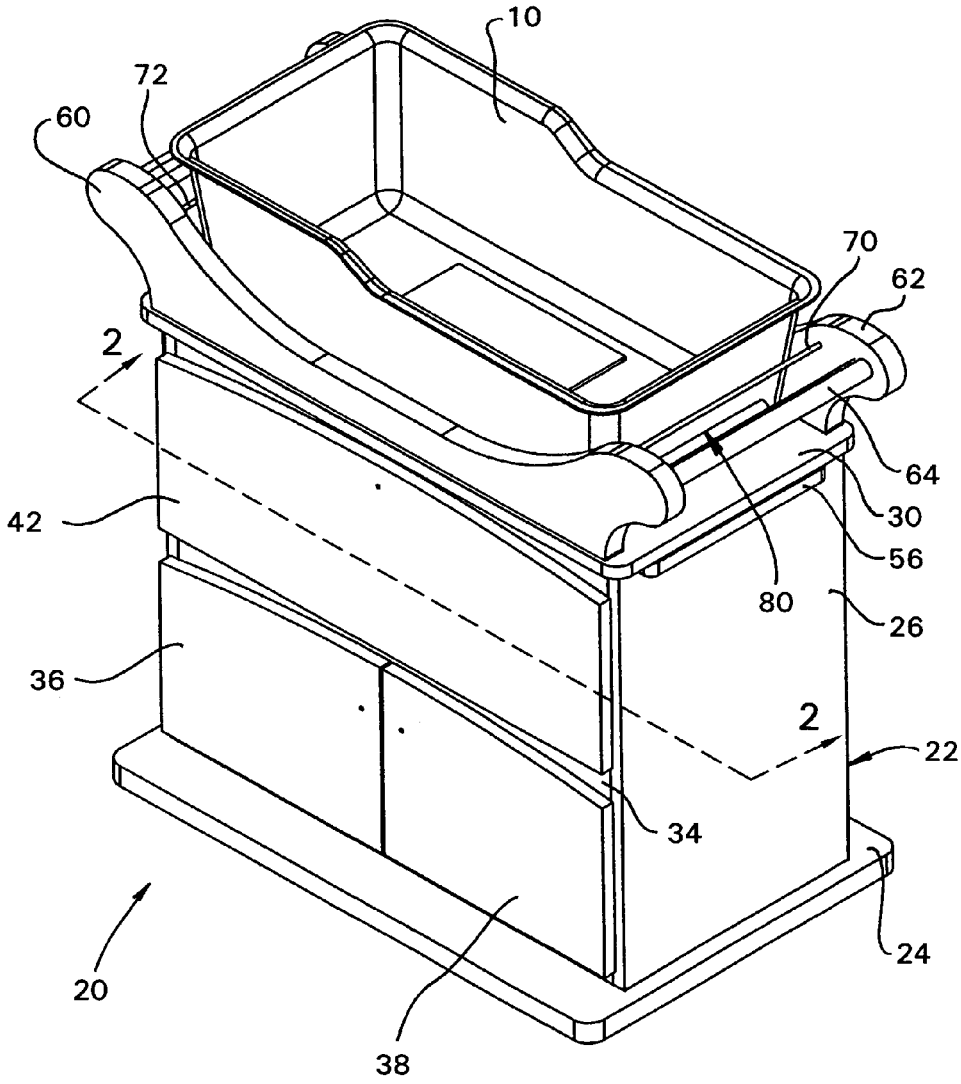
FIG. 1 is a general perspective view of a bassinet positioned on a bassinet support unit.

Certain terminology will be used in the following description for convenience and reference only and will not be limiting. The words "up", "down", "right" and "left" will designate directions in the drawings to which reference is made. The words "in" and "out" will refer to directions toward and away from, respectively, the geometric center of the apparatus and designated parts thereof. Such terminology will include derivatives and words of similar import.

Figure 2:
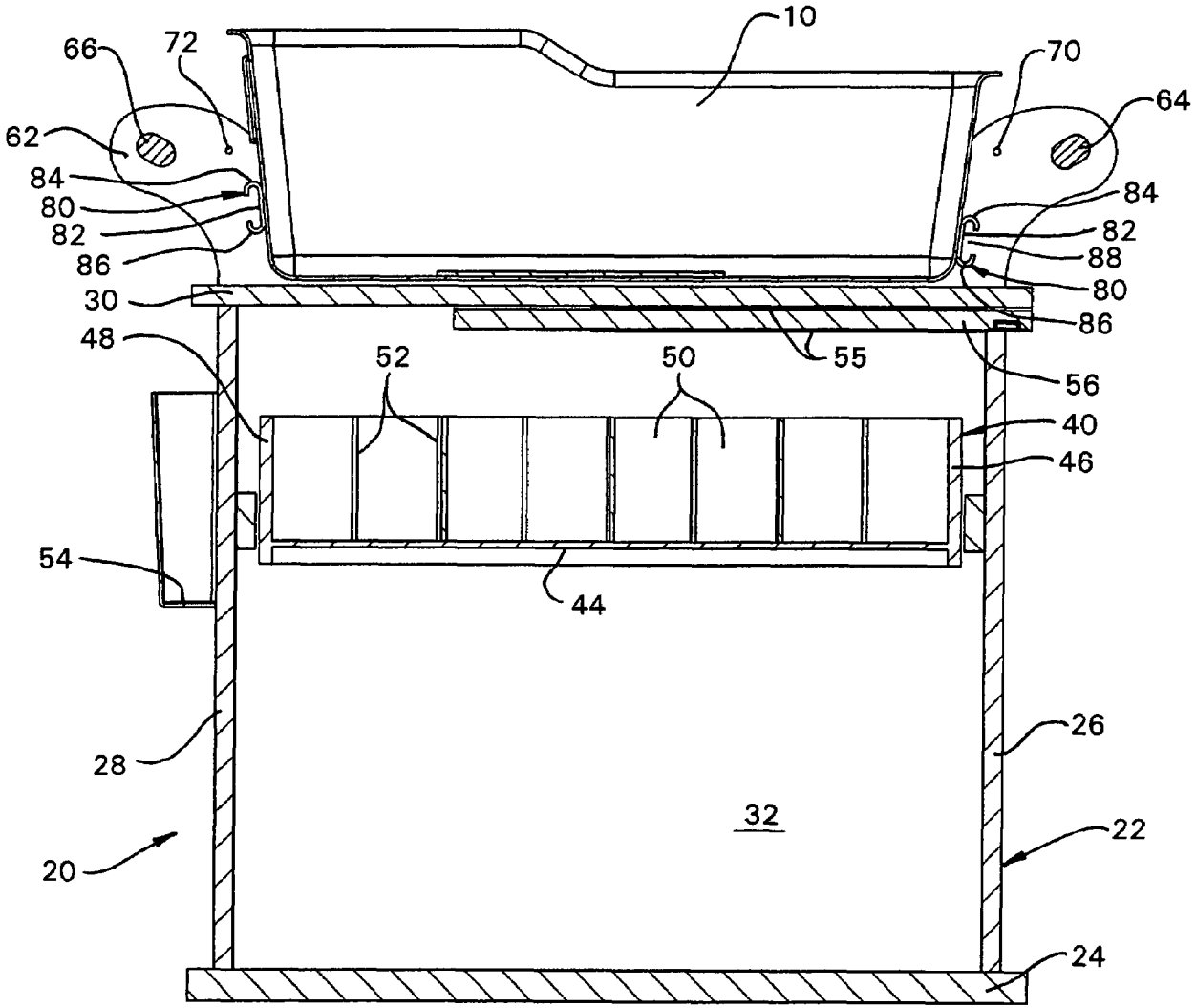
FIG. 2 is a cross sectional view taken at 2—2 of FIG. 1 showing the bassinet resting on the bassinet support unit.

Referring to FIGS. 1 and 2, a tub-shaped bassinet 10 and a bassinet support unit 20 are illustrated. The bassinet support unit 20 includes a closed base structure 22. The base structure 22 has a floor engaging base 24 and side walls 26, 28. The base structure 22 includes a back wall 32 and a front wall 34 with openings that receive door panels 36, 38. A planar generally rectangular top piece 30 secures to the side walls 26, 28 and the front and back walls 32, 34. The base 20, the side walls 26, 28, the back wall 32 and the front wall 34 define the base structure 22.

An opening in the front wall 34 receives a drawer 40, which is supported in the base structure 22. The drawer 40 includes a front drawer panel 42, a drawer bottom wall 44 and drawer side walls 46, 48. As illustrated in FIG. 2, the drawer 40 includes a drawer back wall 50 and partitions 52 dividing the drawer into sections.

The bassinet support unit 20 includes a file holder 54 mounted to the side wall panel 28. The bassinet support unit 20 further includes a retractable tray 56 that mounts on tray rails 55 in a slot type opening in the side wall 26 adjacent the top piece 30. The tray 56 slidably extends from the base structure 22 and is stowed in the position illustrated in FIGS. 1 and 2.

As shown in FIG. 1, the bassinet support unit 20 includes elongate side rails 60, 62 that mount to a top surface of the top piece 30. Each of the side rails 60, 62 extends along substantially the entire length of the top piece 30 at outer edges thereof.

The bassinet support unit 20 includes elongate push handles 64, 66 mounted to and extending between respective ends of the side rails 60, 62 transverse to a longitudinal axis of the top piece 30. The handles 64, 66 are spaced above the top piece 30. The side rails 60, 62 and handles 64, 66 extend about the outer edges of the planar top piece 30 and provide a closed space for receiving the bassinet 10 and maintaining the bassinet on the top piece 30.

Castered wheels (not shown), are commonly secured to the base 24 of the bassinet support unit 20. The castered wheels enable convenient movement of the bassinet between rooms without any lifting or movement of the bassinet from the bassinet support unit that may disturb an infant therein. The push handles 64, 66 provide a convenient location for applying force to move the bassinet support unit 20.

The above-described bassinet support unit 20 is generally old and well known in the art and the invention is not limited to any particular type of support unit. For example, the bassinet support unit 20 can be provided with open shelves.

Elongate support rods 70, 72 have ends that are received in openings at respective ends of the side rails 60, 62. The support rods 70, 72 are spaced above the top piece 30 and extend across the top piece in a direction transverse to the longitudinal axis of the top piece. As shown in FIG. 2, the support rods 70, 72 are each spaced inwardly from the respective handle 64, 66.

C-shaped hook elements 80 mount to outer parts at the ends of the bassinet 10 and project outwardly therefrom. Each C-shaped hook element 80 includes a flat central portion 82 that secures to the bassinet 10. Each C-shaped hook element 80 also includes an upper end portion 84 and a lower end portion 86. The upper end portions 84 and lower end portions 86 are each dimensioned to receive and retain a part of one of the support rods 70, 72 therein. As shown in FIG. 2, the area between the upper end portion 84 and the lower end portion 86 of the C-shaped hook element 80 defines a channel 88 extending therebetween.

Figure 5:
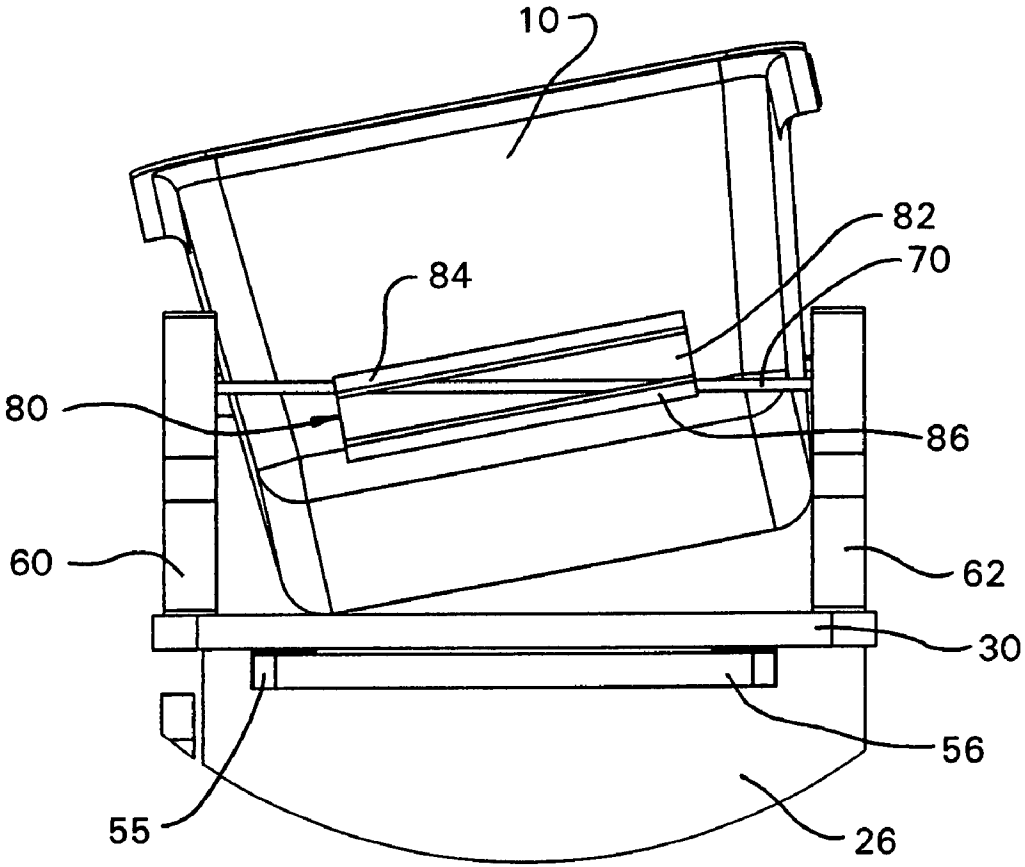
FIG. 5 is a fragmentary end view of the bassinet and fragmentary end view of the bassinet support unit showing a hook element retaining the bassinet.

The C-shaped hook elements 80 extend laterally across the width of the bassinet 20 at the respective end thereof a distance that is more than one-half of the entire width thereacross, and preferably more than two-thirds of the entire width thereacross as illustrated in FIG. 5.

Figure 3:
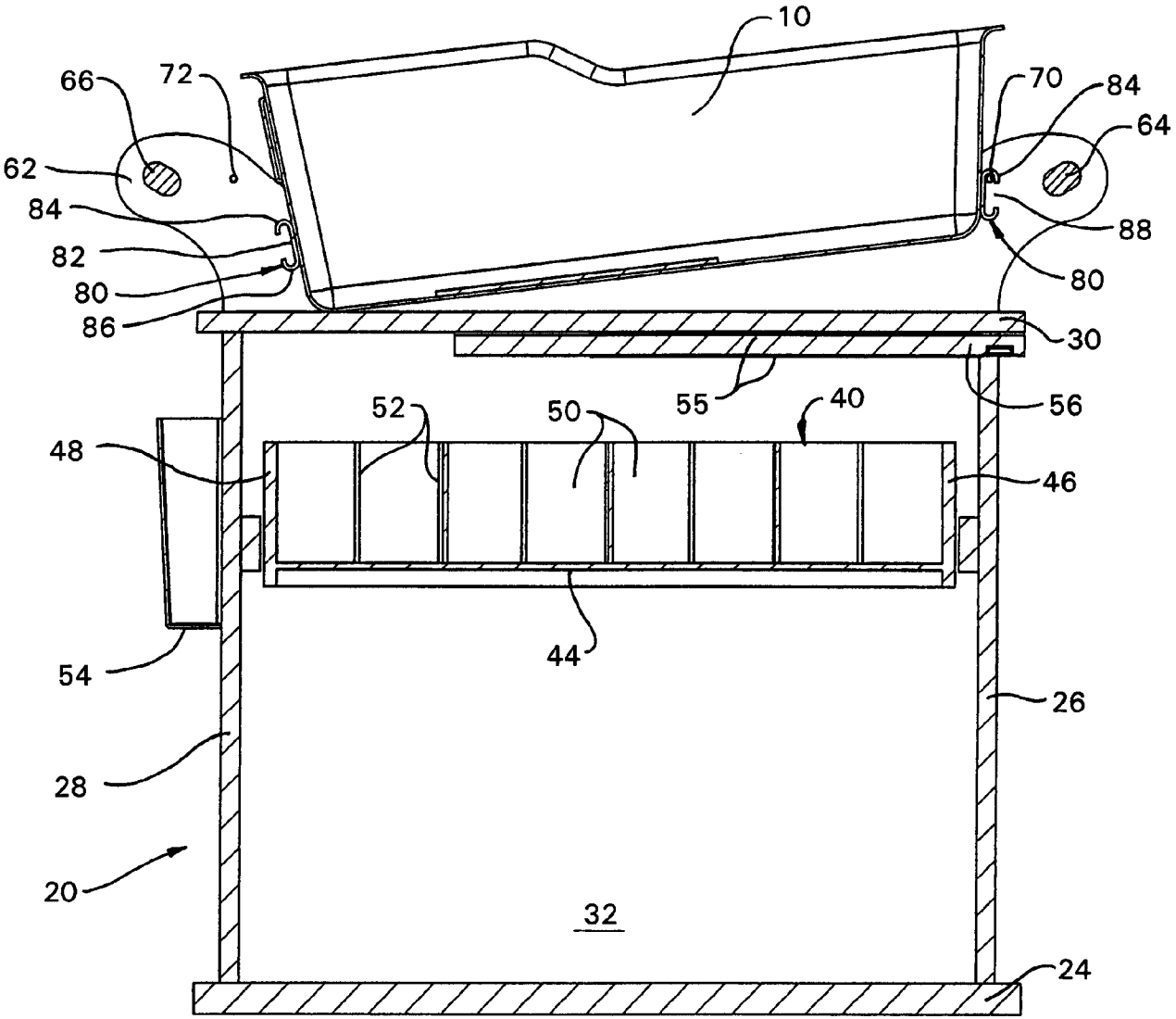
FIG. 3 is a cross sectional view taken at 2—2 of FIG. 1, except the bassinet is illustrated attached to a support rod in an inclined position.
Figure 4:
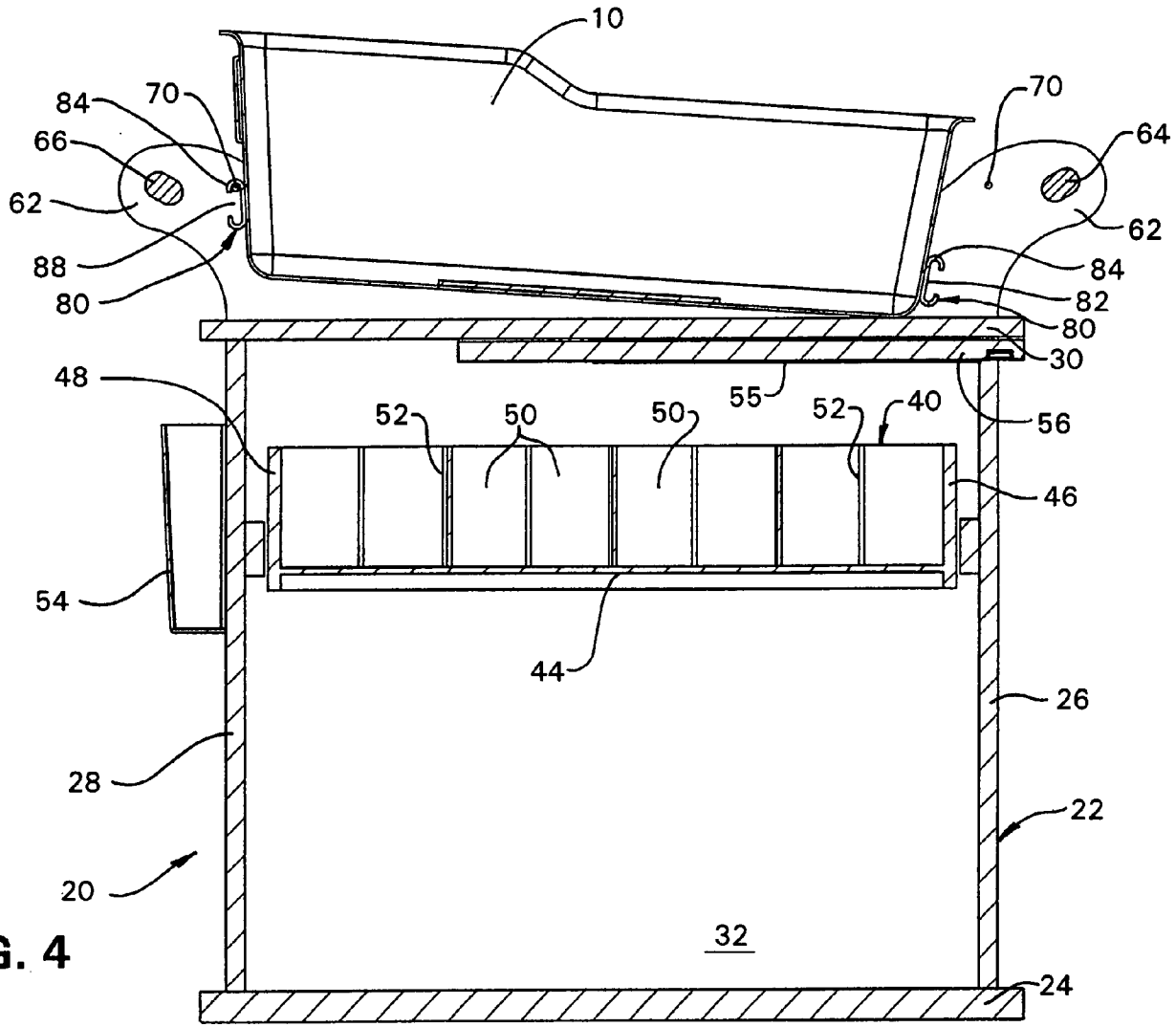
FIG. 4 is a sectional view taken at 2—2 in FIG. 1, except the bassinet is attached to a support rod and in an inclined reverse position.

The C-shaped hook elements 80 project outwardly from the ends of the bassinet 10 a predetermined distance. As shown in FIGS. 2–4, the support rods 70, 72 are spaced from each other a predetermined distance so that the first and second C-shaped hook elements cannot simultaneously engage both of the support rods.

In operation, a user places the bassinet 10 on the support unit 20 in the flat rest position illustrated in FIG. 2. The side rails 60, 62 and handles 64, 66 ensure the bassinet will remain on the top piece 30. If the bassinet 10 must be utilized in the inclined position illustrated in FIG. 3, the user moves the C-shaped hook element 80 to receive the elongate rod 70 in the upper end portion 84. Thus, the bassinet 10 is placed in an inclined Trendelenburg position.

When an at least partly upward force is applied to the bassinet 10 in the inclined position, the bassinet shifts sidewardly and contacts one of the elongate side rails 60, 62 and/or moves upwardly thus rotating about a longitudinal axis of the basinet. As the bassinet 10 rotates, the lower end portion 86 of the C-shaped hook element 80 receives part of the elongate rod 70. As shown in FIG. 5, the lower end portion 86 of the C-shaped hook element 80 thus prevents further rotation of the bassinet 10 about its longitudinal axis. By limiting the potential rotation of the bassinet 10, the lower end portion 86 of the C-shaped hook element 80 prevents tipping of the bassinet 10 and maintains the bassinet on the top piece 30 of the bassinet support unit 20 in the inclined position.

In response to a substantially vertical force applied to the bassinet 10, the lower end portion 86 of the hook element 80 receives the support rod 70 along substantially the entire length thereof and thus limits upward movement of the bassinet.

The C-shaped hook element 80 that receives the support rod 72 operates in the same manner as the hook element and the support rod 70 as described above.

In some embodiments, the predetermined distance between the upper end portion 84 and the lower end portion 86 of the C-shaped hook element 80 (width of the channel 88) is varied to control the amount of rotation of the bassinet 10 about its longitudinal axis before such rotation is limited.

While the Figs. illustrate a single C-shaped hook element 80 extending across the width at each end of the bassinet 10, in another embodiment each C-shaped hook element 80 is defined by a plurality of C-shaped hook elements (not shown) having a narrow width. The plural narrow C-shaped hook elements have the same cross-section as the C-shaped hook elements 80 disclosed above. The plural narrow C-shaped hook elements are spaced horizontally across the width at the end of the bassinet at positions that define a horizontal path for receiving the respective support rod 70, 72. Thus, this embodiment operates in a similar manner to the first embodiment having a single C-shaped hook element extending thereacross.

In some embodiments, the lower end portion 86 is a base element that is separate from the upper end portion 84, which then defines a separate hook element. In these embodiments the at least one base element is attached separately to the end of the bassinet.

In one of such embodiments, the hook elements comprise a combination of hook elements having a J-shaped cross-section and opening downwardly as is known in the prior art and separate base elements spaced below the J-shaped hook elements and secured to the end of the bassinet. The base elements project outwardly from the end of the bassinet 10 a predetermined distance and have upwardly oriented surfaces facing the openings of the J-shaped hook elements. The base elements are oriented horizontally across the bassinet 10 so that the upwardly oriented surfaces are substantially equidistant from the openings of the corresponding J-shaped hook elements.

In another such embodiment, the base element comprises a single monolithic upwardly opening hook element having a J-shaped cross-section and extending across substantially the entire width of the bassinet. In yet another embodiment, the base elements comprise a plurality of upwardly opening hook elements having a J-shaped cross-section spaced horizontally across the bassinet. The downwardly opening and the opposing upwardly opening J-shaped hook elements define a horizontally oriented gap therebetween and extending across the end of the bassinet to receive the respective support rod 70, 72.

Finally, in some embodiments the base elements may have an upwardly oriented flat surface. For example, the hook element can be a downwardly opening hook element having a J-shaped cross-section and the base element can be an outwardly projecting element having a substantially flat surface facing upwardly. In other embodiments, the hook element and the base element having an upwardly facing substantially flat surface can be parts of a single monolithic member mounted to the end of the bassinet.

While less desirable than a hook type of element, the substantially flat surface of the base element is capable of contacting a respective support rod 70, 72 to limit rotation of the bassinet about a longitudinal axis thereof. Thus, even with a flat surface, the base element, in combination with a downwardly opening hook element, operates in a similar manner as the preferred C-shaped hook element 80.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A combination comprising:

a tub-shaped bassinet having a first end and a second end;

a bassinet support unit comprising:

a base structure including a planar top; and elongate side rails located at side edges of said top and extending substantially the entire length of said top;

the improvement comprising:

a first elongate support rod having respective ends mounted to said side rails, said first support rod being oriented substantially transverse to the length of said top, said first support rod being located adjacent a first end of said top and said first end of said bassinet, said first support rod being spaced a predetermined distance from a surface of said top, and at least one first hook element having a substantially C-shaped cross section with a central portion mounted to said first end of said bassinet across a width thereof, and said first hook element including an upper end portion and a lower end portion that project both outwardly away from said bassinet and toward each other for receiving said first rod, wherein said bassinet is configured for placement onto said top and being contained thereat by said elongate side rails, and wherein said first hook element of said bassinet is configured for attachment to said first support rod to position said first end of said bassinet at an elevation above said second end of said bassinet.

2. The combination of claim 1, wherein said first hook element extends laterally across the width of said first end of said bassinet a distance that is more than one half of the width thereacross, said first hook element being a unitary member defining a channel for receiving said first support rod, wherein, in operation, said first hook element and said first support rod received therein, limit rotation of the bassinet about a longitudinal axis thereof when the upper end portion of said first hook element contacts a first part of said rod and the lower end portion of said first hook element contacts a second different part of said rod spaced from the first part, whereby an unintentional pivoting of said bassinet about said longitudinal axis off from said top of said bassinet support unit is prevented.

3. The combination of claim 2, wherein the distance between the upper end portion and the lower end portion of said first hook element determines the amount of rotation along a longitudinal axis of said bassinet before said hook element and said first rod coact to limit the rotation.

4. The combination of claim 1, wherein said first hook element extends across the end of the bassinet a distance that is more than one half of the width across the end of said bassinet.

5. The combination of claim 4, wherein the distance between the upper end portion and the lower end portion of said first hook element determines the amount of rotation along a longitudinal axis of said bassinet before said hook element and said first rod coact to limit the rotation.

6. The combination of claim 1, the improvement further comprising:

a second elongate support rod having respective ends mounted to said side rails, said second support rod being oriented substantially transverse to the length of said top, said second support rod being located adjacent a second end of said top and said second end of said bassinet, said second support rod being spaced a predetermined distance from the surface of said top, and at least one second hook element having a substantially C-shaped cross section with a central portion secured across a width at the second end of said bassinet, and said second hook element being a unitary member including an upper end portion and a lower end portion that project both outwardly away from said bassinet and toward each other for receiving said second support rod.

7. The combination of claim 6, said bassinet support unit further comprising first and second elongate handles, said first handle being mounted between opposing first ends of said side rails and spaced outwardly from said first support rod and said first handle being oriented transverse to the length of said top, and said second handle being mounted between opposing second ends of said side rails and spaced outwardly from said second support rod and said second handle being oriented transverse to the length of said top.

8. The combination of claim 6, wherein said second hook element and said second support rod received therein, in combination, limit rotation of the bassinet about the longitudinal axis thereof.

9. The combination of claim 6, wherein said first hook element secured to said first support rod is configured to position the bassinet in a Trendelenburg position at a first angle and wherein said second hook element secured to said second support rod is configured to position the bassinet in a reverse Trendelenburg position at a second angle.

10. The combination of claim 6, wherein said support rods are spaced from each other a predetermined distance and said hook elements project outwardly from said bassinet a predetermined distance so that both of said first and second hook elements cannot simultaneously engage the corresponding said first and second support rods.

11. The combination of claim 1, wherein the lower end portion C-shaped hook element prevents upward movement of the bassinet.

12. A combination comprising:

a tub-shaped bassinet having a first end and a second end;

a bassinet support unit comprising:

a base structure including a planar top; and elongate side rails located at side edges of said top and extending substantially the entire length of said top; and a first elongate support rod having respective ends mounted to said side rails, said first support rod being oriented substantially transverse to the length of said top, said first support rod being located adjacent a first end of said top and said first end of said bassinet, said first support rod being spaced a predetermined distance from a surface of said top, the improvement comprising:

at least one first hook element with a first portion mounted to said first end of said bassinet across a width thereof, said first portion projecting outwardly away from said end of said bassinet and said at least one first hook element having a second portion projecting downwardly from an outward end of said first portion to define an opening for receiving said first support rod to support said bassinet, and at least one base element mounted to said first end of said bassinet and spaced below said at least one first hook element, said at least one base element extending outwardly from and oriented horizontally across the width of the end of said bassinet, and said at least one base element having a surface facing the opening of said at least one first hook element, wherein said bassinet is configured for placement onto said top and being contained thereat by said elongate side rails, wherein said at least one first hook element of said bassinet is configured for attachment to said first support rod to position said first end of said bassinet at an elevation above said second end of said bassinet, and wherein, in operation, said at least one first hook element and said first support rod received therein, limit rotation of the bassinet about a longitudinal axis thereof when the upper end portion of said at least one first hook element contacts a first part of said support rod and the surface of said at least one base element contacts a second different part of said support rod spaced from the first part, whereby an unintentional pivoting of said bassinet about said longitudinal axis off from said top of said bassinet support unit is prevented.

13. The combination of claim 12, wherein said at least one base element comprises at least one second upwardly opening hook element having a substantially J-shaped cross section.

14. The combination of claim 13 wherein said at least one first hook element has a substantially J-shaped cross section.

15. The combination of claim 12 wherein said at least one first hook element has a substantially J-shaped cross section.

16. The combination of claim 12, wherein said at least one base element comprises an outward projection having a flat surface facing said at least one first hook element.

17. The combination of claim 16, wherein said at least one base element is free from a second outward portion projecting upwardly from an outward end of said outward portion to define an opening for receiving said first support rod.

* * * * *